US006935024B2

(12) United States Patent
Shimizu

(10) Patent No.: US 6,935,024 B2
(45) Date of Patent: Aug. 30, 2005

(54) METHOD OF MANUFACTURING RIMS FOR MOTOR VEHICLES

(75) Inventor: Kiichi Shimizu, Anjo (JP)

(73) Assignee: Central Motor Wheel Co., Ltd., Anjo (JP)

( * ) Notice: Subject to any disclaimer, the term of this patent is extended or adjusted under 35 U.S.C. 154(b) by 0 days.

(21) Appl. No.: 10/387,568

(22) Filed: Mar. 14, 2003

(65) Prior Publication Data

US 2004/0177507 A1 Sep. 16, 2004

(51) Int. Cl.[7] ..... B21K 1/38

(52) U.S. Cl. ..... 29/894.353; 29/894.35; 29/894.354; 72/353.6; 72/393; 301/6.91

(58) Field of Search ..... 29/894.353, 894.354, 29/894.35; 72/353.4, 353.6, 393; 152/381.5, 381.6, 153; 301/6.91

(56) References Cited

U.S. PATENT DOCUMENTS

| | | | | | |
|---|---|---|---|---|---|
| 3,270,794 | A | * | 9/1966 | Skidmore | 152/153 |
| 4,190,092 | A | * | 2/1980 | Evans et al. | 152/381.4 |
| 4,985,993 | A | * | 1/1991 | Yagi et al. | 29/894.353 |
| 5,479,974 | A | * | 1/1996 | Noggle et al. | 152/333.1 |
| 5,579,578 | A | * | 12/1996 | Ashley, Jr. | 29/894.322 |
| 5,664,329 | A | * | 9/1997 | Nickel | 29/894.324 |
| 5,899,253 | A | * | 5/1999 | Marron et al. | 152/381.5 |
| 6,106,075 | A | * | 8/2000 | Suenaga | 301/6.91 |
| 6,183,047 | B1 | * | 2/2001 | Kuhl | 301/95.106 |
| 6,309,026 | B1 | * | 10/2001 | Svedhem | 301/6.91 |
| 6,390,563 | B1 | * | 5/2002 | Haverkamp et al. | 301/6.91 |
| 6,450,225 | B2 | * | 9/2002 | Yukawa et al. | 152/381.6 |
| 6,516,849 | B2 | * | 2/2003 | Flament et al. | 152/400 |
| 6,519,852 | B1 | * | 2/2003 | Chen | 29/894.353 |
| 6,533,009 | B2 | * | 3/2003 | Aoki | 152/381.6 |
| 6,598,636 | B1 | * | 7/2003 | Schurmann et al. | 152/450 |
| 6,648,421 | B1 | * | 11/2003 | Akiyoshi et al. | 301/6.91 |
| 2001/0015249 | A1 | * | 8/2001 | Mohr | 152/381.6 |
| 2002/0144760 | A1 | * | 10/2002 | Devizzi et al. | 152/209.2 |
| 2003/0020320 | A1 | * | 1/2003 | Yukawa et al. | 301/6.91 |
| 2003/0197422 | A1 | * | 10/2003 | Akiyoshi et al. | 301/6.91 |

FOREIGN PATENT DOCUMENTS

| | | | | |
|---|---|---|---|---|
| JP | 63137005 A | * | 6/1988 | B60C/19/00 |
| JP | 06-106903 | | 4/1994 | |
| JP | 07-117404 | | 5/1995 | |
| JP | 10-085881 | | 4/1998 | |
| JP | 11-245605 | | 9/1999 | |
| JP | 2002187405 A | * | 7/2002 | B60B/21/02 |

* cited by examiner

*Primary Examiner*—Essama Omgba
(74) *Attorney, Agent, or Firm*—Connolly Bove Lodge & Hutz LLP

(57) ABSTRACT

A process of manufacturing a rim for a motor vehicle from an original pipe, in order to facilitate formation of projections for reducing road noise on the rim, comprises a projection forming step of partially extruding a ledge portion of an intermediate pipe for the rim from inside to outside in a radial direction of the ledge portion so as to form a plurality of projections at suitable intervals.

12 Claims, 10 Drawing Sheets

METHOD OF MANUFACTURING RIMS FOR MOTOR VEHICLES

BACKGROUND OF THE INVENTION

1. Field of the Invention

The present invention relates to a method of manufacturing rims for motor vehicles, and more particularly to a method of manufacturing the rims of disk wheels for motor vehicles capable of helping reduce road noise.

2. Description of the Related Art

It is already known that, in a tire for motor vehicles, road noise is aggravated by columnar resonance in the airfilling area (closed space) formed between the inner circumferential face of the tire and the outer circumferential face of the disk wheel rim. This is due to the phenomenon that the resonance of the airfilling area formed by the tire and the rim is kept constant irrespective of the revolutions of the tire, and the resultant vibration at a constant frequency in the same direction is added all the time, because the airfilling area has the same cross-sectional area in the circumferential direction of the tire.

As a method to restrain this aggravation in road noise, there is disclosed in JP-A-11-245605 a method intended to reduce road noise by fitting a plurality of movable shielding plates in the rim well part, so that these shielding plates be erected upright by the centrifugal force during the running of the vehicle to partition the airfilling area and thereby to shift the frequency of columnar resonance to a vibration frequency region in which no road noise problem can arise. This will be referred to as the First Case of the related art.

On the other hand, JP-B2-3003478 discloses a technique that a flexible ring on which a plurality of bulkheads are formed to partition the airfilling area is inserted into the inner space of the tire to reduce road noise as attempted in the above case. This will be referred to as the Second Case of the related art.

In both of the first and second Cases of the related art, an element separately formed from the disk wheel, such as shielding plates or a flexible ring, is fitted thereto. Thus, this invites an increase in cost and, moreover, the first Case involves the risk that the tire, when it is fitted, may strike against the shielding plates and break them.

SUMMARY OF THE INVENTION

An object of the present invention is to provide a method of manufacturing a rim for a motor vehicle which permits easy production of a rim capable of solving the problems noted above.

In order to solve the aforementioned problems, according to the invention, a method of manufacturing a rim for a motor vehicle from an original pipe comprises a projection forming step of partially extruding a ledge portion in an intermediate pipe of the rim from inside to outside in the radial direction to form a plurality of projections on the ledge portion at suitable intervals.

According to the invention, the projection forming step may be accomplished by arranging forming dies for projection forming inside and outside of the intermediate pipe and shifting the inside die outwards in the radial direction of the rim to form the projections by pressing.

Also according to the invention, the final shape of the rim may be formed after the projection forming step.

Further according to the invention, the original pipe may be subjected to preliminary forming into a prescribed shape over the full width of the rim by using a pair of forming rollers before the projection forming step.

In addition, according to the invention, flared forming and preliminary forming may as well be accomplished in a single round of pressing before the projection forming step.

BRIEF DESCRIPTION OF THE DRAWINGS

FIG. 7A is a forming process diagram, and FIG. 7B shows how the sectional shape of the rim changes as it is formed in FIG. 7A.

FIG. 15A is a forming process diagram, and FIG. 15B shows how the sectional shape of the rim changes as it is formed in FIG. 15A.

DESCRIPTION OF THE PREFERRED EMBODIMENTS

Preferred embodiments according to the present invention will be described below with reference to the accompanying drawings.

First will be described a rim produced by the manufacturing method according to the invention.

Figure 1:
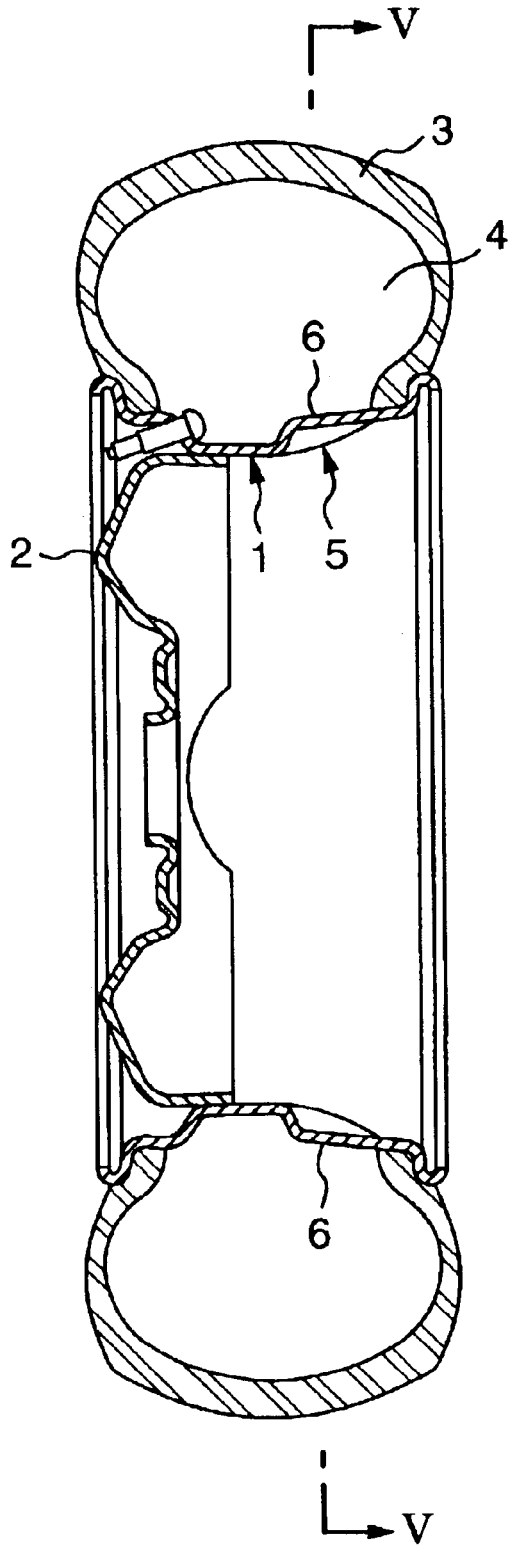
FIG. 1 is a profile of a rim formed by a manufacturing method according to the invention when fitted with a tire.
Figure 2:
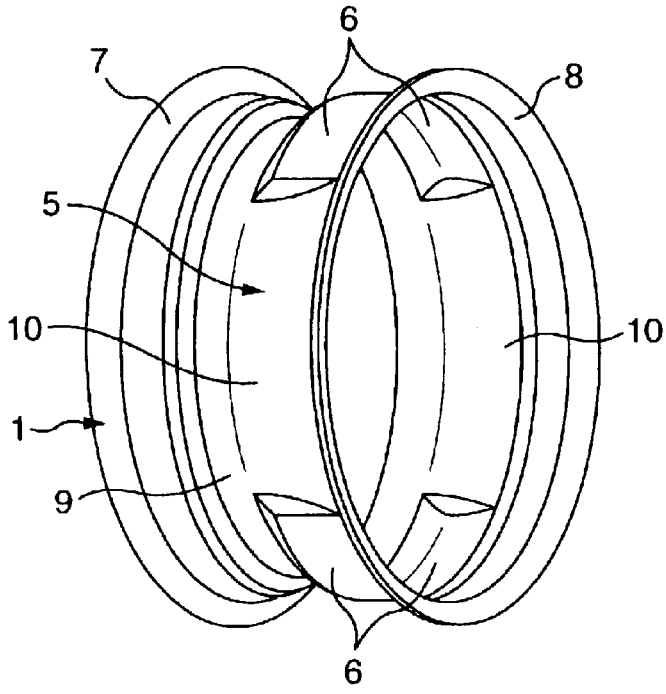
FIG. 2 is a perspective view of the rim shown in FIG. 1.
Figure 3:
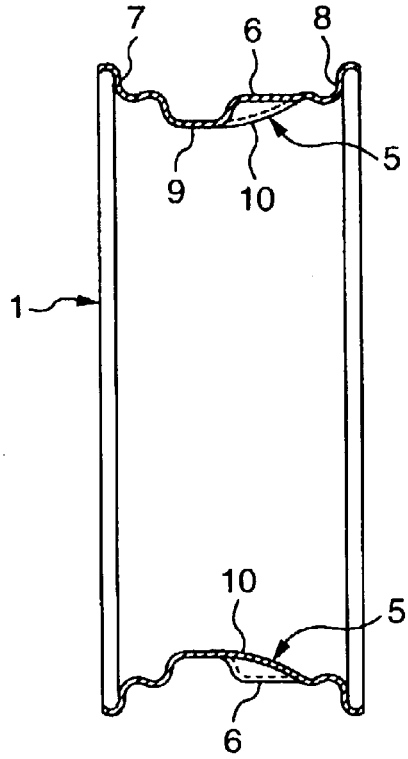
FIG. 3 is a sectional side view of the rim taken along a III—III line in FIG. 4.
Figure 4:
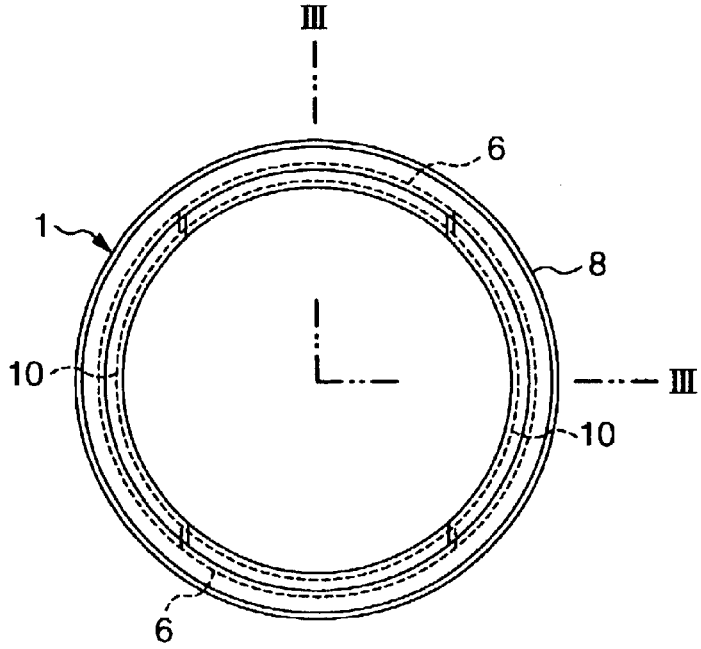
FIG. 4 is a front view of the rim shown in FIG. 2.
Figure 5:
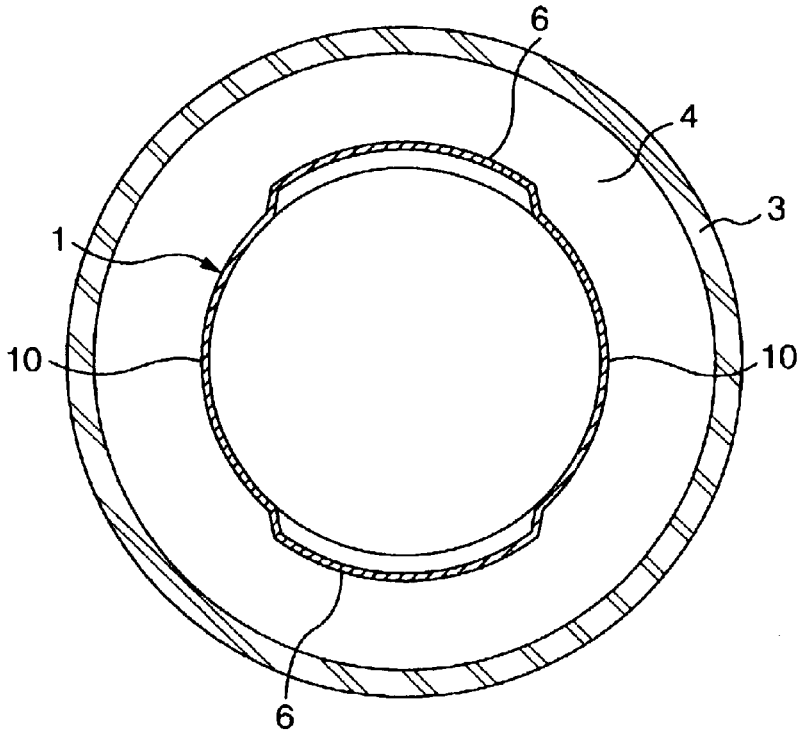
FIG. 5 shows a sectional view taken along a V—V line in FIG. 1.

FIG. 1 shows a vertical section of a rim manufactured according to the invention when fitted with a tire. In a two-piece type wheel wherein a disk 2 is fitted into and fastened within a rim 1, a tire 3 is fitted with the outer circumference of the rim 1. An airfilling area 4 is formed between the outer circumferential face of the rim 1 and the inner circumferential face of the tire 3.

The shape of the rim 1 will now be described with reference to FIG. 2 through FIG. 6.

Figure 6:
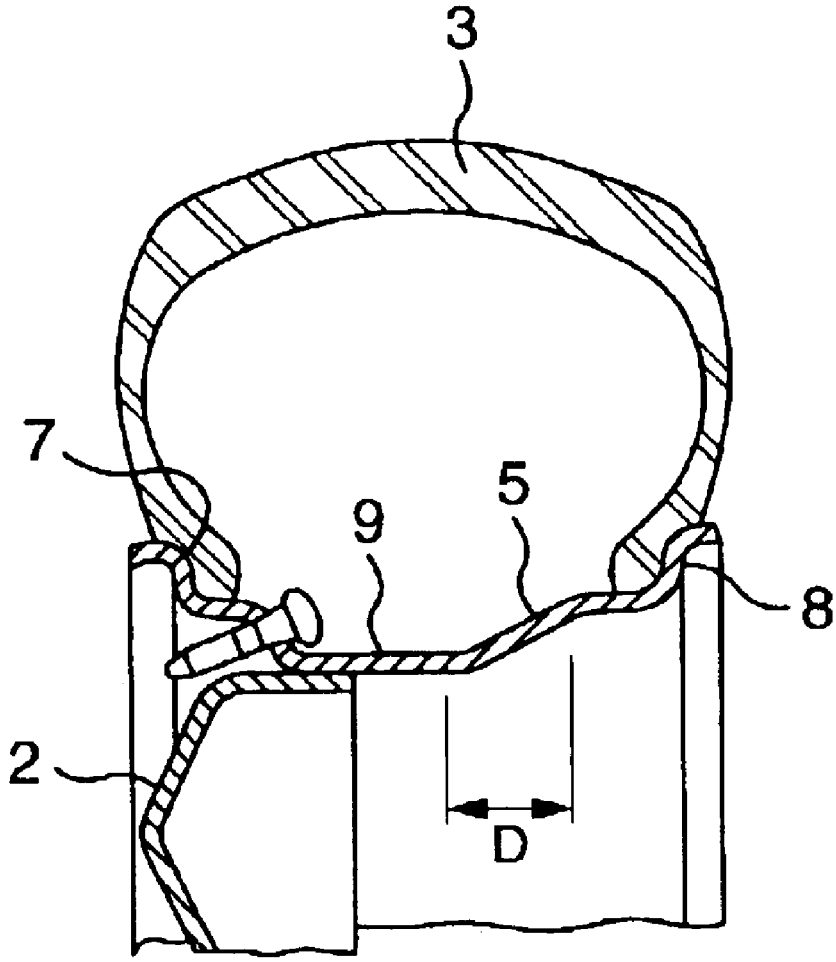
FIG. 6 is a sectional side view for explaining the ledge portion of the rim.

In the ledge portion 5 of the rim 1, projections 6 are formed at appropriate intervals, and the projections 6 are formed by extruding the rim itself partially outwards (outwards in the radial direction). The ledge portion 5 here means the other portion than the two bead seat portions 7 and 8 into which the tire 3 is fitted and the drop portion 9 into which the disk 2 is fitted and fixed as shown in FIG. 6, namely the portion of the range D in FIG. 6.

By partially forming the projections 6 in the circumferential direction as described above, the projections 6 and concave portions 10, formed elsewhere than the projections 6, are formed alternately on the ledge portion 5 in the circumferential direction, namely in the revolving direction of the tire.

Further, the peaks of the projections 6 are formed substantially on a circle about an axis of the rim, mid the concave portions 10 are also formed substantially on a circle about an axis of the run.

The projections 6 and the concave portions 10 are so formed that the sectional area of the airfilling area 4, surrounded by the tire 3 and the rim 1, in the circumferential direction varies by not less than 2%, preferably about 2.5%, relatively at the projections 6 and the concave portions 10. Thus, they are so formed that the sectional area of the airfilling area 4 in the circumferential direction at the projections 6 is smaller by not less than 2%, preferably 2.5% than that at the concave portions 10.

Whereas a desired number of the projections 6 in the circumferential direction of the rim 1 are to be provided, it is preferable to divide the ledge portion 5 of the rim 1 into four equal parts as in the embodiment illustrated here, and to alternately arrange the projections 6 and the concave portions 10 in each of the ¼ parts so that two projections 6 be opposite each other 180 degrees apart and two concave portions 10 opposite each other 180 degrees apart.

By forming concaves and projections on the ledge portion 5 of the rim 1 as described above and thereby varying the sectional area of the airfilling area 4 in the circumferential direction, namely in the revolving direction of the tire, the revolutions of the tire 3 during the running of the vehicle cause the parts of the tire 3 where the projection 6 is positioned and the other parts of the tire 3 where the concave portion 10 is positioned to alternately come into contact with the ground, and the sectional area of the airfilling area 4 in the ground-contacting part varies with the revolutions of the tire, with the result that the frequency of columnar resonance can be shifted to a region of vibration frequency where no road noise problem arises and the direction of strike can also be varied.

Experiments using a wheel, in which the projections 6 and the concave portions 10 were arranged in their respective positions in the illustrated embodiment and the sectional area of the air filling area 4 varied by 2.5% in the circumferential direction, succeeded in reducing road noise by 3 to 6 dB in the frequency range of 200 to 300 Hz where road noise did generate.

Next will be described a method of manufacturing the rim 1 on which the projections 6 are formed.

Figure 7A:
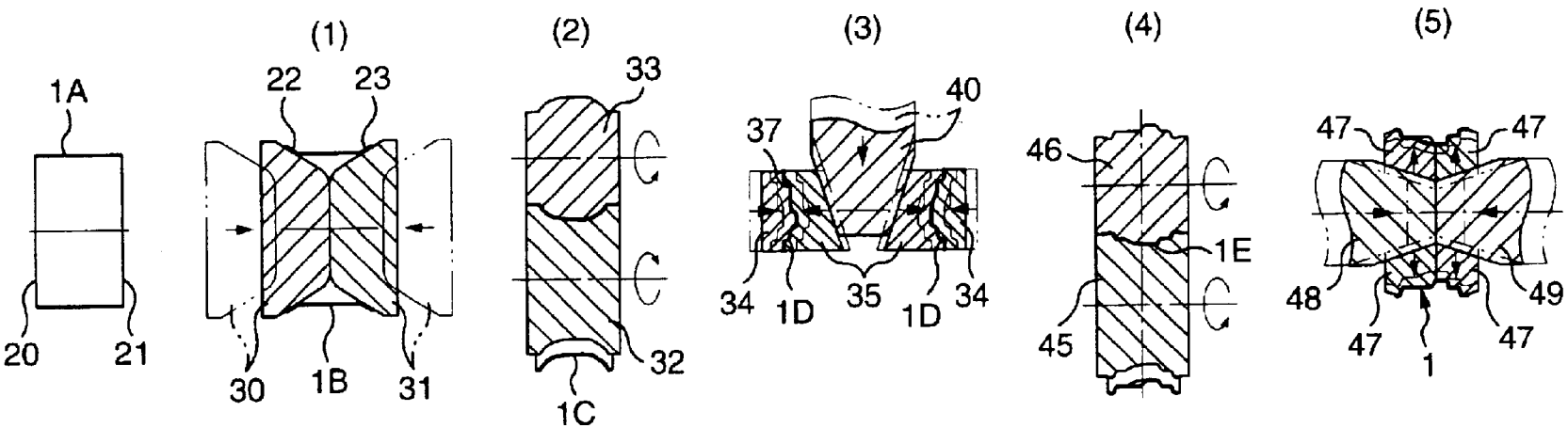
FIGS. 7A and 7B illustrate a first preferred embodiment of the manufacturing method according to the invention.
Figure 7B:
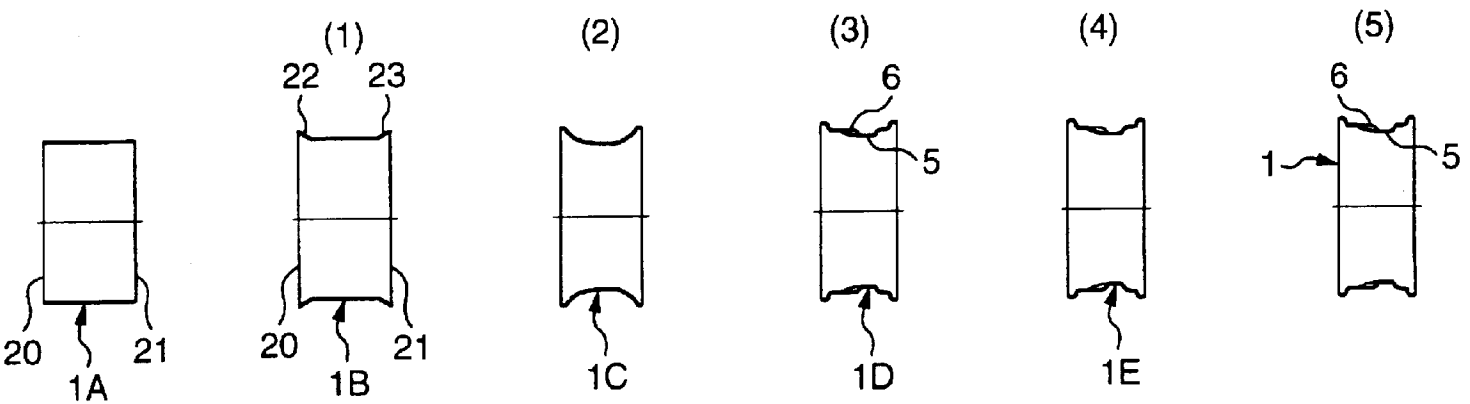

FIGS. 7A and 7B illustrate a first preferred embodiment of the manufacturing method according to the invention.

FIG. 7A is a forming process diagram, and FIG. 7B shows how the sectional shape of the rim changes as it is formed in FIG. 7A.

In FIG. 7A, first a metallic original pipe 1A for the rim is made ready. The original pipe 1A has a prescribed diameter, and is open at both ends 20 and 21.

Then, as the first step (1), flared dies 30 and 31 are pressed into two ends 20 and 21 of the original pipe 1A in the arrowed direction to obtain a first intermediate pipe 1B with flares 22 and 23 formed at its two ends.

Next, as the second step (2), the first intermediate pipe 1B is subjected to preliminary forming by a pair of first rolls 32 and 33, which are inner and outer rolls, to obtain a second intermediate pipe 1C. This preliminary forming is to shape a preliminary figure as illustrated in FIG. 7B(2) for a flanged portion, a hump portion, a ledge portion, a drop portion and so forth to be definitely formed at a later step, and is intended to ensure shaping and prevent board thickness decrease at the later step.

Then, as the third step (3), the projections 6 are formed on the second intermediate pipe 1C obtained by the preliminary forming by pressing process. This step will be referred to as a projection forming step. Incidentally at this step, other portions than the projections 6 are also formed if required.

Figure 8:
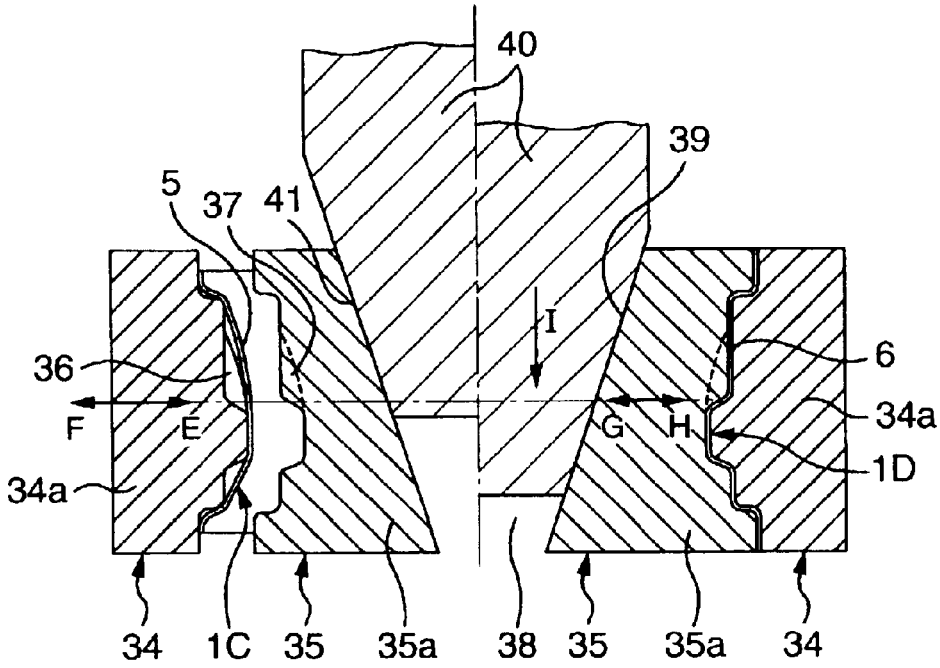
FIG. 8 is an enlarged sectional side view of a forming die for explaining the third step (3) in FIG. 7A, wherein the left half shows the state before forming, and the right half shows the state after forming.
Figure 9:
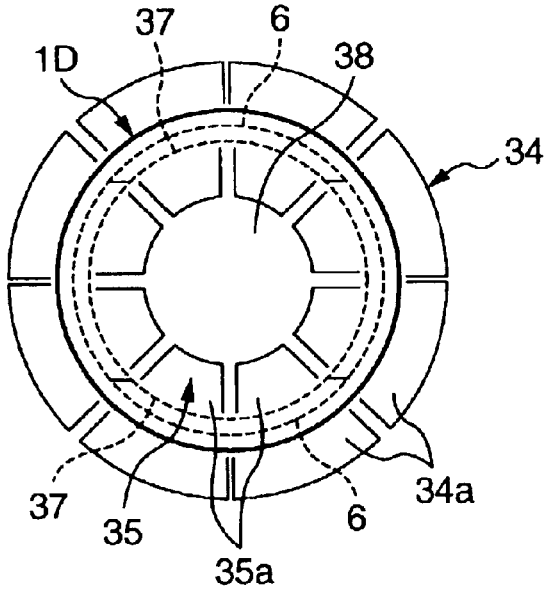
FIG. 9 is a plan of the forming die in FIG. 8.

The forming die for use at this third step is shown in FIG. 8 and FIG. 9. This forming die consists of an annular outer die 34 and an annular inner die 35. Further, the outer die 34 and the inner die 35, as shown in FIG. 9, are radially split into a plurality each of split dies 34*a* and 35*a*. It is preferable for them to be split by 2 to 14, and in the illustrated case they are divided into eight parts each. Further, the split dies 34*a* of the outer die 34 are provided to be movable in their radial direction (the arrowed E-F direction in FIG. 8), and drive means (not shown) is provided to move them. On the inner face of the outer die 34 are formed a concave face 36 on which the projections 6 are formed and other faces in desired shapes.

The split dies 35*a* of the inner die 35 are provided to be also movable in their radial direction (the arrowed G-H direction in FIG. 8). On the outer face of the inner die 35 are formed a convex face 37 on which the projections 6 are formed and other faces in desired shapes. In the central portion of the inner die 35 is bored a conic hole 38 of which the part in the axial direction is shrunken in diameter, and the inner face of each of the split dies 35*a* of the inner die 35 is formed into a tapered face 39.

In the position of the hole 38 of the inner die 35 is arranged a cam 40 which is vertically shifted coaxially with the inner die 35, and the cam 40 is shifted up and down by drive means (not shown). At the tip of the cam 40 is formed a pressing face 41 consisting of a tapered face along the tapering angle of the tapered face 39, and shifting the cam 40 in the arrowed I direction causes the pressing face 41 to press each of the split dies 35*a* of the inner die 35 outwards in the radial direction.

In order to carry out the third step (3) by using the forming die, the split dies 34*a* of the outer die 34 are moved in the arrowed F direction to expand the diameter of the outer die 34 and, at the same time, the split dies 35*a* of the inner die 35 are moved in the arrowed G direction to compress the diameter of the inner die 35. Then, the second intermediate pipe 1C formed at the second step (2) is positioned to intervene between this outer die 34 and the inner die 35 to move the split dies 34*a* of the outer die 34 in the arrowed E direction to clamp the second intermediate pipe 1C (the state on the left side of FIG. 8).

Figure 10:
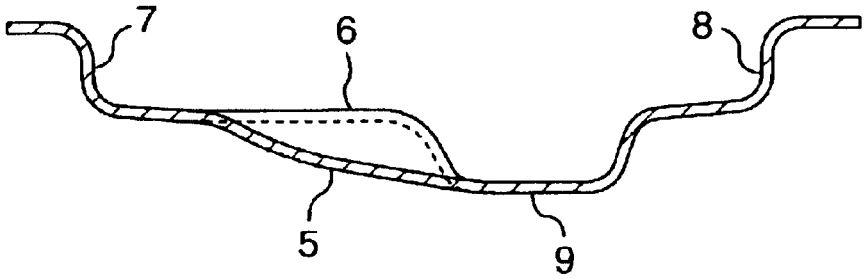
FIG. 10 is an enlarged sectional view of the rim formed at the third step (3) in FIG. 7A.

Then, the cam 40 is shifted down in the arrowed I direction. This downward shift causes the pressing face 41 of the cam 40 to slide in engagement with the tapered face 39 of each split die 35*a* of the inner die 35, and each split die 35*a* of the inner die 35 is moved by being pressed outwards in the radial direction (the arrowed H direction) by a component force of the load in the axial direction of the cam 40. When the inner die 35 is pressed and moved in this way, as shown on the right side of FIG. 8, the convex face 37 formed on that inner die 35 subjects part of the ledge portion in the second intermediate pipe 1C to extrusion (protrusion) forming to form the projections 6, resulting in the forming of a third intermediate pipe 1D by pressing. The shapes of a projection 6 formed by this third step and its surroundings are shown in FIG. 10.

Forming of the projections 6 outwards in the radial direction in this way almost eliminates movements of the material in the axial direction and keeps fluctuations in the direction of the rim width to the minimum.

Figure 11:
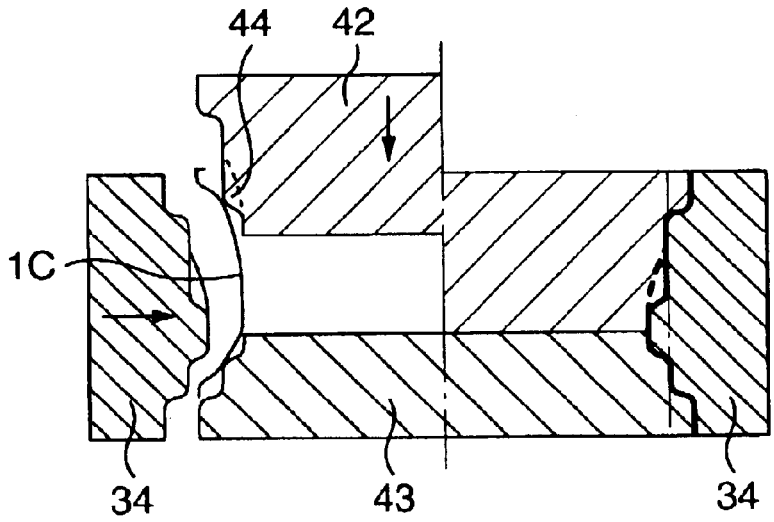
FIG. 11 is an enlarged sectional side view of a forming die for comparison with the present invention, wherein the left half shows the state before forming, and the right half shows the state after forming.
Figure 12:
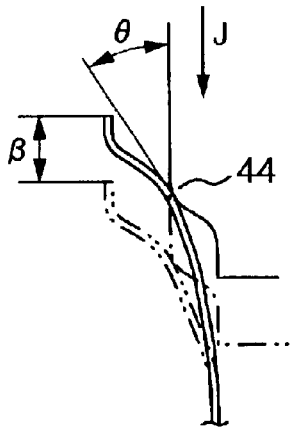
FIG. 12 is an explanatory diagram of formation using the forming die of FIG. 11.

For instance as shown in FIG. 11, where an inside upper die 42 and an inside lower die 43 are used as inside dies and a convex face 44 is formed on this inside upper die 42 and, after clamping the second intermediate pipe 1C with the outer die 34 similar to the foregoing, the inside upper die 42 is moved in the axial direction as shown by an arrow in FIG. 11 to form the projections 6 by the axial moving of the convex face 44, the tangential angle θ between the material and the convex face 44 becomes greater as shown in FIG. 12 to increase frictional resistance, with the result that the material is pressed in the axial direction to invite buckling as represented by β in FIG. 12. Such buckling will lead to increased fluctuations of the rim width and a narrowed flange width, and the product will be rejected as failing to meet the requirement. This necessitates increasing the material width to allow for the narrowing, entailing a problem of poor economy.

By contrast, in the embodiment according to the present invention, the projections 6 are formed by pressing process in the radial direction, which means forming to draw the material and accordingly can solve the problem noted above.

It is also conceivable as a forming method for the projections 6 to subject to concave forming the parts of the ledge portion other than the projections 6 from the outer circumferential side towards the inner circumferential face side, but this would constitute so-called compressive forming, which is more difficult than usual protrusion forming. For this reason, in the embodiment of the invention, the projections 6 are formed by protrusion forming of making them convex from the inner face towards the outer face of the ledge portion 5, and the forming of the projections 6 is thereby facilitated.

The final shape of the rim is formed by the following step after the above-described projection forming step.

Figure 13:
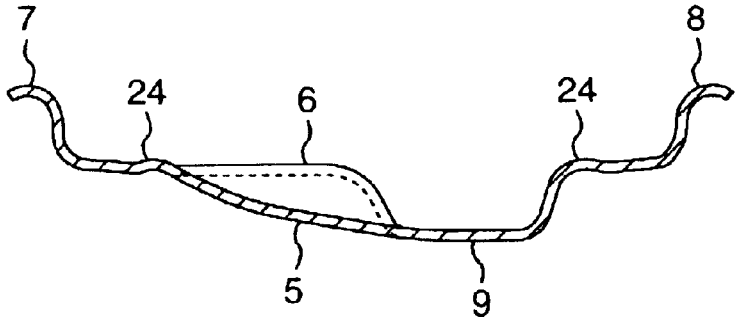
FIG. 13 is a sectional side view of the rim formed at the fourth step (4) in FIG. 7A.

As the fourth step (4), the bead seat portions, the hump portion and the drop portion in the third intermediate pipe 1D formed at the foregoing third step are shaped and its flanged portion is curled with a pair of third rolls 45 and 46, which are inner and outer rolls, thereby accomplishing preliminary forming into a prescribed shape over the full width of the rim to form a fourth intermediate pipe 1E. The shape formed by this fourth step (4) is shown in FIG. 13. In FIG. 13, reference numeral 5 denotes the ledge portion, 7 and 8, the bead seat portions, 9, the drop portion, and 24, the hump portion.

Figure 14:
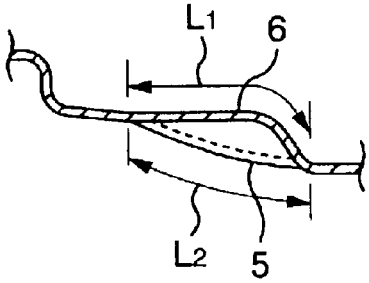
FIG. 14 is a sectional side view for explaining the lengths of the projection and of the ledge portion formed at the third step in FIG. 7A.

This fourth step (4) is carried out to adjust the shapes in other regions than the projections 6 because, at the foregoing third step (3), mainly the convex forming of the projections 6 on the ledge portion 5 is performed and, as shown in FIG. 14, the line length $L_1$ of the projections 6 formed at the third step (3) is greater than the line length $L_2$ of the ledge portion 5 (by about 10%), resulting in a greater degree of forming than in other regions and, moreover, the lack of assurance for the shapes of those other regions.

Next, as the fifth step (5), as shown in FIG. 7A(5), the fourth intermediate pipe 1E is arranged on the outer circumference of an inner die 47 consisting of split dies, tapered cams 48 and 49 are moved in the arrowed direction in the drawing to suppress the inner die 47 outwards in the radial direction, and thus, the fourth intermediate pipe 1E is expanded in diameter from the inside to the outside to be formed into prescribed dimensions and run-out accuracy. This fifth step (5) is the same as its counterpart in conventional rim forming. Upon completion of this fifth step (5), as shown in FIG. 7B(5), the rim 1 on which the projections 6 are formed as shown in FIG. 1 through FIG. 5 can be obtained.

Next will be described, with reference to FIG. 15, another method of manufacturing the rim 1 on which the projections 6 are formed.

In this second preferred embodiment according to the invention, the first step (1) and the second step (2) in the first embodiment illustrated in FIG. 7A are integrated into a single step.

Figure 15A:
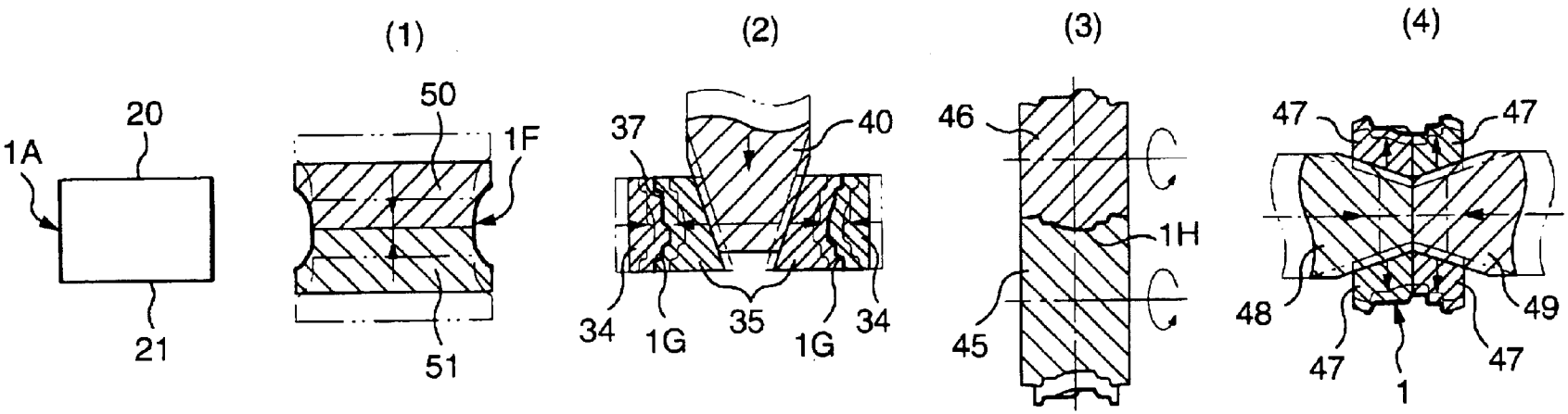
FIGS. 15A and 15B illustrate a second preferred embodiment of a manufacturing method according to the invention.
Figure 15B:
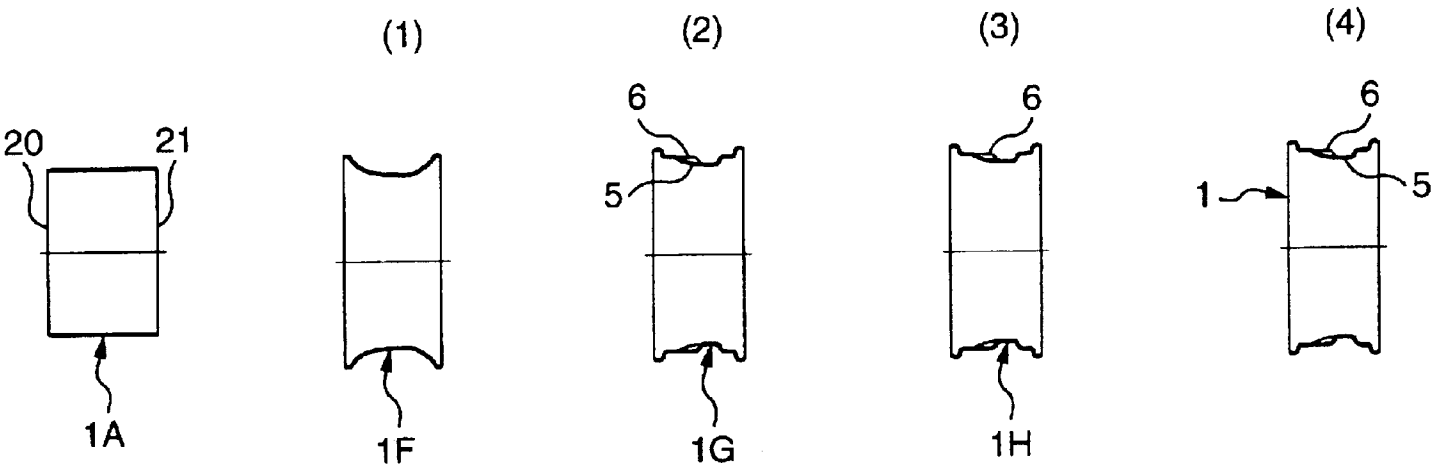

FIG. 15A shows a forming process, and FIG. 15B shows how the sectional shape of the rim changes as it is formed.

In FIG. 15A, first a metallic original pipe 1A for the rim is made ready. The original pipe 1A has a prescribed diameter, and is open at both ends 20 and 21.

Then, as the first step (1), forming dies 50 and 51 are pressed into the original pipe 1A from the two open ends 20 and 21 in the arrowed direction for preliminary forming of a first intermediate pipe 1F in substantially the same shape as in FIG. 7B(2) for the first embodiment by pressing process. Thus, a flanged portion, a hump portion, a ledge portion and a drop portion are preliminarily formed, and the flanged portion is formed to be rounded at the same time. It is preferable to accomplish this forming by so arranging the original pipe 1A that its two open ends 20 and 21 be directed upwards and downwards, respectively, and by using the upper forming die 50 and the lower forming die 51. Obviously, the outer circumferential die faces of both forming dies 50 and 51 are formed into die faces which permit forming of shapes equivalent to the shape shown in FIG. 7B(2) for the first embodiment. It is so disposed that the original pipe 1A be extruded outwards in the radial direction by the two forming dies 50 and 51 and its material be subjected to draw forming.

Though this first step (1) is forming of the original pipe 1A in the axial direction, since the processing gradient is small, this step involves little frictional resistance, is free from wrinkle and board thickness decrease, and permits uniform forming.

Next, as the second step (2), the first intermediate pipe 1F is pressed by using the outer die 34, the inner die 35 and the cam 40 similar to their respective counterparts in the first embodiment at the third step (3) shown in FIG. 7A and in a similar forming direction, so as to obtain a second intermediate pipe 1G of the same shape as that shown in FIG. 7B(3) for the first embodiment. At this second step (2), too, similarly to the aforementioned, the process is one of draw forming, i.e. the material is drawn.

Next, as the third step (3), the second intermediate pipe 1G is formed by a similar forming method using a pair of similar third rolls 45 and 46, which are inner and outer rolls, to the fourth step (4) shown in FIG. 7A for the first embodiment, to obtain a third intermediate pipe 1H of the same shape as in FIG. 7B (4) for the first embodiment.

Then, as the fourth step (4), the third intermediate pipe 1H is formed by a similar forming method using the similar inner die 47 and cams 48 and 49 to the fifth step (5) shown in FIG. 7A for the first embodiment, to obtain the rim 1 in the same shape as FIG. 7B(5) for the first embodiment.

In the manufacturing method of this second embodiment, since the steps (1) and (2) mainly consist of pressing processes, it is basically draw forming, i.e. the material is drawn.

Figure 16:
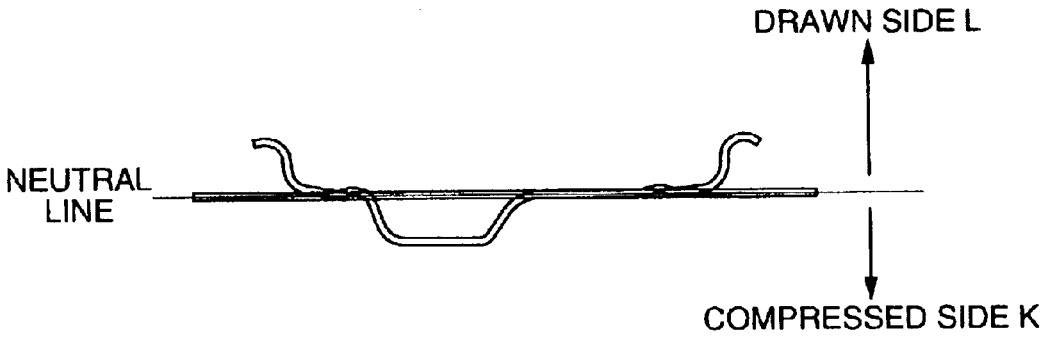
FIG. 16 is a sectional side view of a rim for explaining the conventional rim forming.

By the conventional rim manufacturing method by rolling, the original pipe material is formed both on the compressed side K and the drawn side L with reference to that original pipe (neutral line) as shown in FIG. 16.

Figure 17:
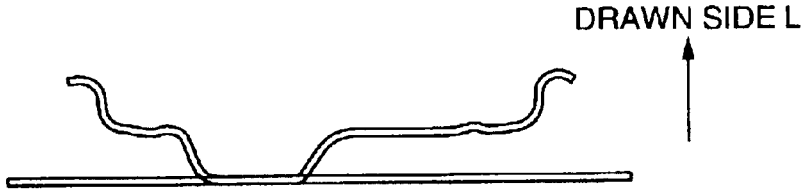
FIG. 17 is a sectional side view for explaining rim forming according to the invention.

By contrast, in the second embodiment, as shown in FIG. 17, since forming at (1) and (2) is wholly worked on the drawn side L as draw forming, it is possible to reduce the quantity of the material use compared with the above-mentioned case of performing both compression and drawing, resulting in reducing the rim weight and cost. For instance for a rim of 15 inches in diameter and 6 inches in width, about 10% saving in material can be achieved.

Furthermore in this second embodiment, since the first step (1) and the second step (2) for the first embodiment (in FIG. 7A) can be accomplished by a single step shown in FIG. 15A(1), the forming process can be reduced by one step compared with the manufacturing method for the first embodiment (in FIG. 7A), resulting in more efficient manufacturing.

According to the present invention, in forming projections to reduce road noise on the rim, they can be shaped more easily.

Further, in the case that the projections are formed by moving the inner mold die outwards in the radial direction of the rim, the material hardly moves in the axial direction of the rim, and length fluctuations of the rim in the axial direction can be kept to the minimum. Thus, supposing that the projections are formed by moving the dies in the axial direction of the rim, the material will move more in the axial direction of the rim, and the pipe material of the rim should be increased in width correspondingly, which would be uneconomical. However, in a case that the projections are formed by the forming in the radial direction of the rim as according to the invention, fluctuations in the widthwise direction of the rim are minimized, making it possible to reduce the product cost and the rim weight compared with the aforementioned forming in the axial direction.

Moreover, forming the projections in the above-described way would involve the risk of variations in the shapes of other regions because the degree of forming is greater for these projections. Therefore, forming the final shape of the rim after forming the projections would give a final shape superior in run-out accuracy and dimensional precision.

Also, in a case that preliminary forming into a prescribed shape is done over the full length of the rim by using a pair of forming rollers before the projection forming step, the right shape can be easily secured and board thickness decrease can be effectively prevented at the later projection forming step.

Further, in a case that flare forming and preliminary forming are to be accomplished in a single round of pressing before the projection forming step, the manufacturing process can be shortened compared with the aforementioned process.

Moreover, the consumption of the material can be reduced, because this pressing constitutes draw forming.

What is claimed is:

1. A method of manufacturing a rim for a motor vehicle from an original pipe comprising a projection forming step of partially extruding from inside to outside in a radial direction a lodge portion in an intermediate pipe of the rim to form a plurality of projections on the ledge portion in a circumferential direction at spaced intervals, wherein said projection forming step is accomplished by arranging forming dies for projection inside and outside of the intermediate pipe, in which forming dies an inside die is divided into a plurality of pieces in a circumferential direction, and after fixing an outside die of said forming dies to said rim, moving said inside die of the forming dies outwards in the radial direction of the rim while keeping said outside die fixed so as to form said projection by a pressing process.

2. A method of manufacturing a rim for a motor vehicle as claimed in claim 1, wherein a final shape of the rim is formed after said projection forming step.

3. A method of manufacturing a rim for a motor vehicle as claimed in claim 2, wherein said original pipe is subjected to preliminary forming into a prescribed shape over a full width of the rim by using a pair of forming rollers before said projection forming step.

4. A method of manufacturing a rim for a motor vehicle as claimed in claim 3, wherein flare forming and preliminary forming are accomplished in a single round of pressing before said projection forming step.

5. A method of manufacturing a rim for a motor vehicle as claimed in claim 2, wherein flare forming and preliminary forming are accomplished in a single round of pressing before said projection forming step.

6. A method of manufacturing a rim for a motor vehicle as claimed in claim 1, wherein said original pipe is subjected to preliminary forming into a prescribed shape over a full width of the rim by using a pair of forming rollers before said projection forming step.

7. A method of manufacturing a rim for a motor vehicle as claimed in claim 6, wherein flare forming and preliminary forming are accomplished in a single round of pressing before said projection forming step.

8. A method of manufacturing a rim for a motor vehicle as claimed in claim 1, wherein flare forming and preliminary forming are accomplished in a single round of pressing before said projection forming step.

9. A method of manufacturing a rim for motor vehicle as claimed in claim 1, wherein said projections are so formed that two projections are opposite to each other 180° apart in the circumferential direction.

10. A method of manufacturing a rim for motor vehicle as claimed in claim 9, wherein a final shape of the rim is formed after said projection forming step.

11. A method of manufacturing a rim for motor vehicle as claimed in claim 9, wherein said original pipe is subjected to preliminary forming into a prescribed shape over a full width of the rim by using a pair of forming rollers before said projection forming step.

12. A method for manufacturing a rim for motor vehicle as claimed in claim 9, wherein flare forming and preliminary forming are accomplished in a single round of pressing before said projection forming step.

* * * * *